US005137269A

United States Patent [19]

Yamamoto

[11] Patent Number: 5,137,269

[45] Date of Patent: Aug. 11, 1992

[54] SHEET PACKAGE AND SHEET FEEDING APPARATUS DESIGNED TO EMPLOY SAME

[75] Inventor: Junichi Yamamoto, Osaka, Japan

[73] Assignee: Minolta Camera Kabushiki Kaisha, Osaka, Japan

[21] Appl. No.: 546,001

[22] Filed: Jun. 28, 1990

[30] Foreign Application Priority Data

Jun. 29, 1989 [JP] Japan ..... 1-169349
Mar. 13, 1990 [JP] Japan ..... 2-62363

[51] Int. Cl.[5] ..... B65H 1/00

[52] U.S. Cl. ..... 271/145; 271/162; 221/197; 221/287; 206/454; 206/455

[58] Field of Search ..... 271/145, 147, 157, 162, 271/164; 206/454, 449, 455, 456; 221/302, 197, 287

[56] References Cited

U.S. PATENT DOCUMENTS 3,306,491 2/1967 Eisner et al. ..... 221/197 X
3,767,188 10/1973 Rosenberg, Jr. et al. ..... 271/145
4,537,307 8/1985 Tamura ..... 271/145 X

FOREIGN PATENT DOCUMENTS 60-15331 1/1985 Japan .
247344 10/1989 Japan ..... 271/145

*Primary Examiner*—David H. Bollinger
*Attorney, Agent, or Firm*—Willian, Brinks, Olds, Hofer, Gilson & Lione

[57] ABSTRACT

Disclosed are a sheet package and a sheet feeding apparatus in which such a sheet package is preferably employed. The sheet package is comprises a cover for covering a stack of sheets in its entirety and openable by being broken away to expose at least an end portion of the stack of sheets and a member extending outward from the bottom of the stack of sheets. The sheet feeding apparatus is provided with cassette body capable of accomodating the sheet package therein, and a holding portion for fixedly holding the extending member of the sheet package.

15 Claims, 12 Drawing Sheets

SHEET PACKAGE AND SHEET FEEDING APPARATUS DESIGNED TO EMPLOY SAME

BACKGROUND OF THE INVENTION

1. Field of the Invention

The present invention relates to sheet packages having paper (sheets) enclosed therein for use in image forming apparatus, such as printers or copying machines, and to sheet feeders for use with the sheet package.

2. Description of the Related Art

For example, the sheet for use in heat transfer printers is synthetic paper having a resin coating over one surface thereof. Accordingly, it is required that the surface of each sheet be held out of contact with the hand to the greatest possible extent and that such sheets be set in the printer with the surface of the sheet oriented properly. For this purpose, sheets are generally enclosed in a package and bear a marker indicating the rear side of the sheet.

When the sheets are taken out of the package and placed into the paper cassette of a printer or the like, the hand is likely to touch the resin coating of the sheet since the sheets are handled manually. Further in the case where characters are printed on the rear side of the sheet as a marker indicating the rear side, the rear side is not usable and therefore reduces the usefulness of the sheet.

In view of the above situation, it has been proposed to use the package itself as a disposable paper cassette (Japanese Laid-Open Patent Application No. 60-15331). However, use of disposable paper cassettes gives rise to a cost problem.

SUMMARY OF THE INVENTION

The main object of the present invention is to provide an improved sheet package free of the foregoing problem and a sheet feeding apparatus for use with the sheet package.

Another object of the present invention is to provide a sheet package which enables the user to place sheets into a sheet feeding apparatus easily as set in position without allowing the hand to touch the sheet, and a sheet cassette for accommodating the sheet package.

Still another object of the present invention is to provide a sheet package which enables the user to set sheets in a sheet feeding apparatus easily and accurately, and such a sheet feeding apparatus for use with the sheet package.

To fulfill the above objects, the present invention provides a sheet package for use in the sheet feeder of an image forming apparatus, the sheet package comprising a cover for covering a stack of sheets in its entirety and openable by being broken away to expose at least an end portion of the stack of sheets, and a member extending outward from the bottom of the stack of sheets.

With use of the sheet package of the present invention, the sheets enclosed therein can be readily set in the sheet feeder of the image forming apparatus by grasping the remaining cover portion without touching the sheet surface with the hand. Further even if the sheets bear no mark indicating the rear side thereof, the position of the extending member relative to the sheet package permit the user to set the sheets in position with the front side properly oriented.

The present invention further provides a sheet cassette or sheet feeder which comprises a portion for accommodating the sheet package therein, and a holding portion for fixedly holding the extending member of the sheet package.

The sheet cassette or sheet feeder of the present invention is adapted to readily fix the extending portion of the sheet package by the holding portion and is free of the likelihood that the cover of the sheet package will be fed in error.

Further according to the present invention, the sheet feeder is provided with means for detecting the extending member of the sheet package, whereby when the sheet package or the sheet cassette having the sheet package accommodated therein has been loaded into the sheet feeder, the sheet package as set accurately in the specified position of the sheet feeder can be detected.

These and other objects, advantages and features of the invention will become apparent from the following description thereof taken in conjunction with the accompanying drawings which illustrate specific embodiments of the invention.

BRIEF DESCRIPTION OF THE DRAWINGS

In the following description, like parts are designated by like reference numbers throughout the several drawings.

DESCRIPTION OF THE PREFERRED EMBODIMENTS

Embodiments of the invention will be described below in detail with reference to the drawings.

Figure 1:
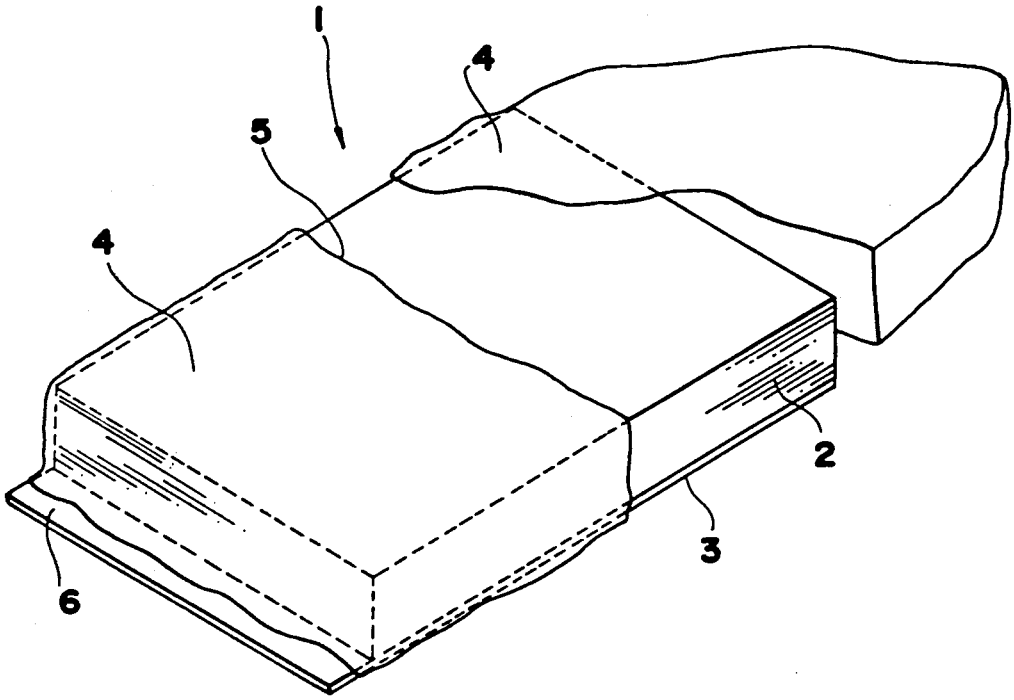
FIG. 1 is a perspective view showing a sheet package as a first embodiment of the invention.

First, a sheet package 1 for use in a sheet cassette will be described. FIG. 1 is a perspective view showing the appearance of the sheet package in its entirety. The sheet package 1 has hermetically enclosed therein a number of sheets of paper 2, for example, about 100 sheets 2, for use in heat transfer printers of the sublimation type. Each of the sheets has an overcoat layer of polyester resin over one surface thereof. The sheets 2 are registered each at its one end (right end illustrated) toward the feed direction and placed on a base plate 3 having a slightly larger length than the sheets 2 and made of paper, synthetic resin or the like. The package 1 is so formed that the stack of sheets 2 is hermetically enclosed in its entirety in a cover 4 in the form of a bag of vinyl or like synthetic resin. With an adhesive or the like, the cover 4 is affixed at a peripheral portion thereof to a projecting portion 6 of the base plate 3 other than the sheet carrying portion thereof. The cover 4 is centrally formed with a perforated line 5, along which the front-side portion of the cover 4 toward the feed direction can be torn off as illustrated, whereby the cover 4 is opened. An unillustrated thin Mylar film or the like is affixed to the perforated portion, such that the sheets 2 are completely sealed off and protected from moisture.

Figure 2:
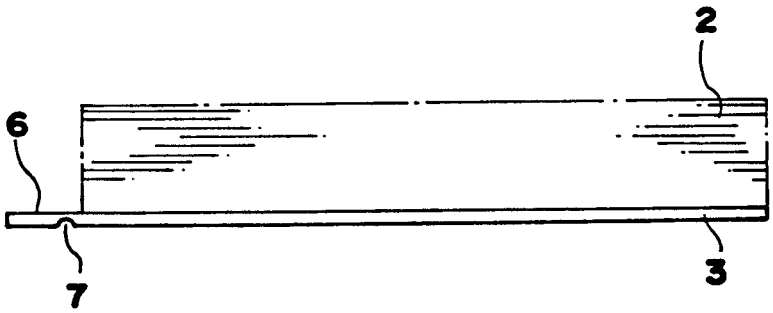
FIG. 2 is a side elevation showing a base plate of the sheet package of FIG. 1.

FIG. 2 is a side elevation showing the base plate 3 of the sheet package. The base plate 3 carries thereon the sheets 2 with their front ends (right ends in the drawing) toward the feed direction in register. A groove 7 extending widthwise of the sheets is formed in the lower side of the projecting portion 6 of the base plate 3 and positioned close to the rear end, with respect to the feed direction, of the stack of sheets 2. The base plate 3 is folded along the groove 7.

The groove 7 need not always be provided, as when the base plate 3 is made of a flexible material such as paper.

Accordingly, the sheet package 1 thus constructed is inexpensive to make and can be opened by partly removing the cover 4 without any need to touch the overcoat layer of the sheet 2 with the hand.

The base plate 3 need not always cover the entire bottom portion of the stack of sheets 2 but may have a size corresponding only to the illustrated leftward portion of the stack or only to the projecting portion 6. Alternatively, the projecting portion may be formed by the cover 4 itself. In this case, the sheet package 1 is smaller and easier to handle for use and dump.

Figure 3A:
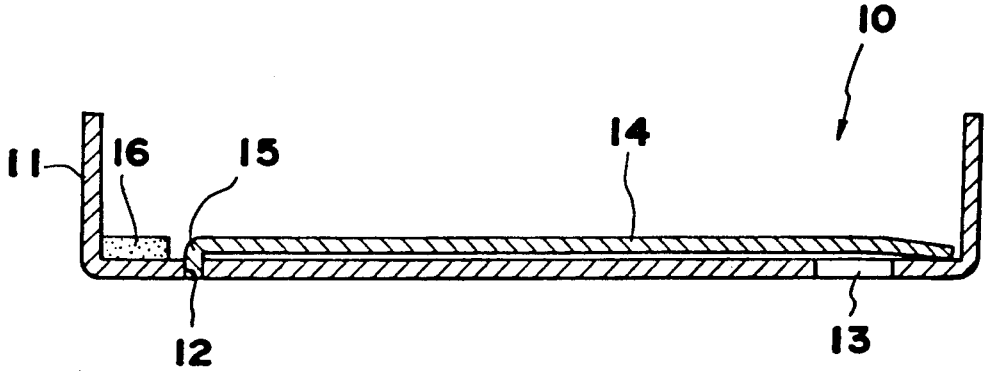
FIGS. 3A and 3B are side elevations showing a sheet cassette for use with the sheet package of FIG. 1, FIG. 3A showing the body of the sheet cassette, FIG. B showing an upper cover as fitted over the body.
Figure 3B:
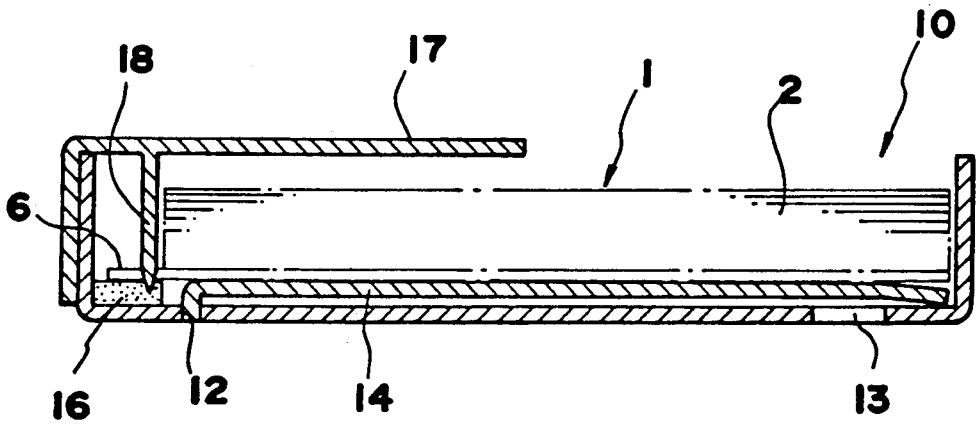

Next, a sheet cassette 10 will be described which is adapted to accommodate the sheet package 1 thus constructed. FIGS. 3A and 3B are side elevations in section showing the sheet cassette according to the first embodiment of the invention; FIG. 3A showing the body of the cassette, and FIG. 3B showing a cassette upper cover as attached to the body. The sheet cassette body 11 is in the form of a box integrally molded of a synthetic resin and has a bottom wall which is formed with an aperture 12 for supporting the rear end 15 of a feed plate 14 and an opening 13 for a pushing-up lever 34 to pass therethrough. The feed plate 14 has substantially the same size as the sheet 2. The rear end 15, which is bent, is inserted in the aperture 12 to support the feed plate 14, and the front or right end of the plate 14 toward the feed direction is pivotally movable. A rubber plate 16 for restraining the projecting portion 6 of the sheet package 1 is attached to the upper side of the bottom wall of the cassette body 11 at the left end thereof.

The upper cover 17 fitted over the cassette body 11 is a closure so formed as to cover the rearward portion (leftward portion in FIG. 3B) of the body 11. The rightward portion of the body is left open, providing a feed opening. At the rear end of the package 1 to be accommodated in the cassette 10, i.e., in the vicinity of rear end of the sheet stack, the upper cover 17 has a flange-like restraining portion 18 extending into the cassette body 11 and having a sharp end.

To set the sheet package 1 in the cassette 10 thus constructed, the upper cover 17 is first removed to completely open the body 11, and the sheet package 1 which is opened by tearing off the forward portion of the cover 4 along the perforated line 5 is placed into the body 11 with the opened portion of the package 1 positioned toward the feed direction. The upper cover 17 is then fitted over the body 11 for closing, whereby the end of the restraining portion 18 of the upper cover 17 is forced into the projecting portion 6 of the package base plate 3 to fixedly set the package 1 in the cassette 10.

Although the restraining portion 18 of the upper cover 17 described is sharp-ended, the end may be saw-toothed.

The sheet cassette 10 having the sheet package 1 accommodated therein is loaded into the body of a printer in the manner to be described below to feed the sheets.

Figure 4A:
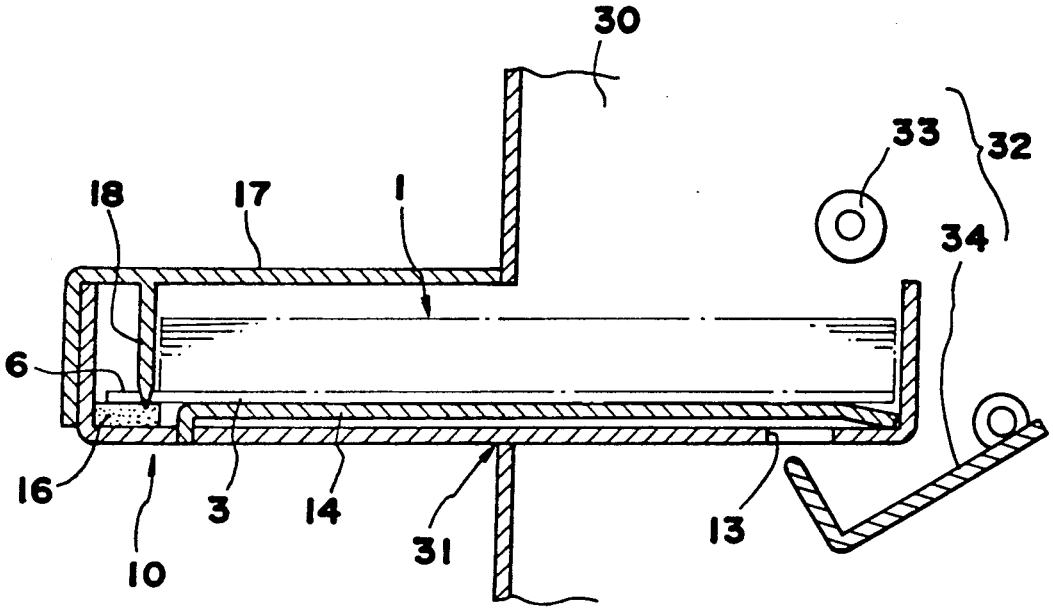
FIGS. 4A and 4B are fragmentary side elevations in section showing the sheet cassette as loaded into the body of a printer, FIG. 4A showing the cassette as placed in position, FIG. 4B showing the same during sheet feeding.
Figure 4B:
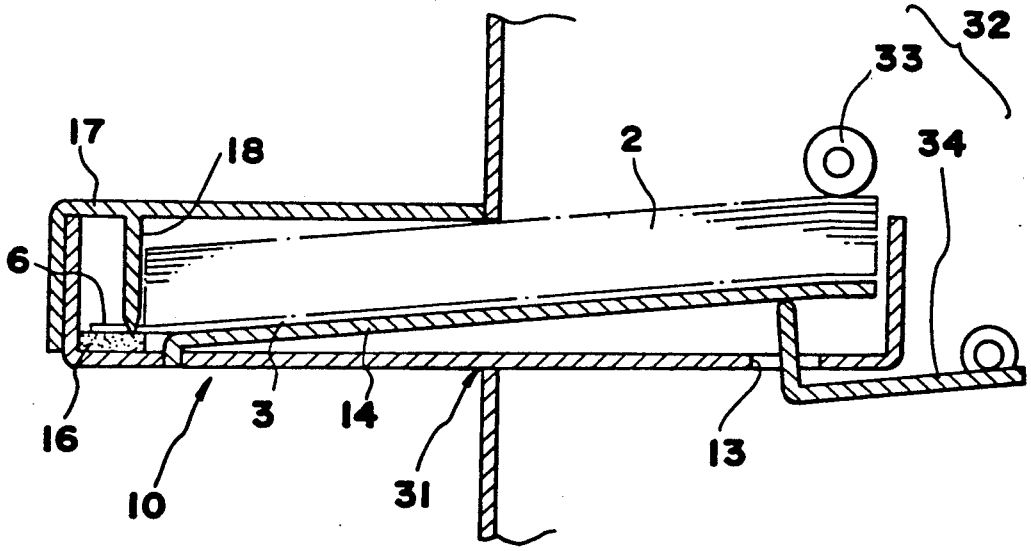

FIGS. 4A and 4B are fragmentary side elevations in section showing the cassette as loaded in the printer body and as set in condition for sheet feeding, respectively. The printer body 30 has an inlet 31 for loading the cassette therethrough, and feed means 32 comprising a feed roller 33 and a pushing-up lever 34. The cassette 10 containing the sheet package 1 is placed into the inlet 31. For feeding, the free end of the pushing-up lever 34 pivotally moves through the opening 13 in the bottom wall of the cassette body 11, lifting the feed plate 14 and the sheet package 1 at their front ends to bring the uppermost sheet 2 into contact with the feed roller 33 as seen in FIG. 4B. The uppermost sheet 2 is sent out rightward by the rotation of the roller 33. At this time, the projecting portion 6 of the package base plate 3 made of thick paper or synthetic resin is held restrained by the restraining portion 18 of the cassette upper cover 17, with the end of the portion 18 engaged in the portion 6, while the rear end of the stack of sheets 2 is guided by the side face of the upper cover restraining portion 18. Consequently, the sheets 2 set in position are held in register without disturbance, and the base plate 3 will not be sent out in error after the cassette 10 becomes empty of the sheet 2. Moreover, there is no likelihood that the sheet package 1 to be loaded will be set as directed reversely or that the sheets 2 will be set as turned upside down in error.

Figure 5A:
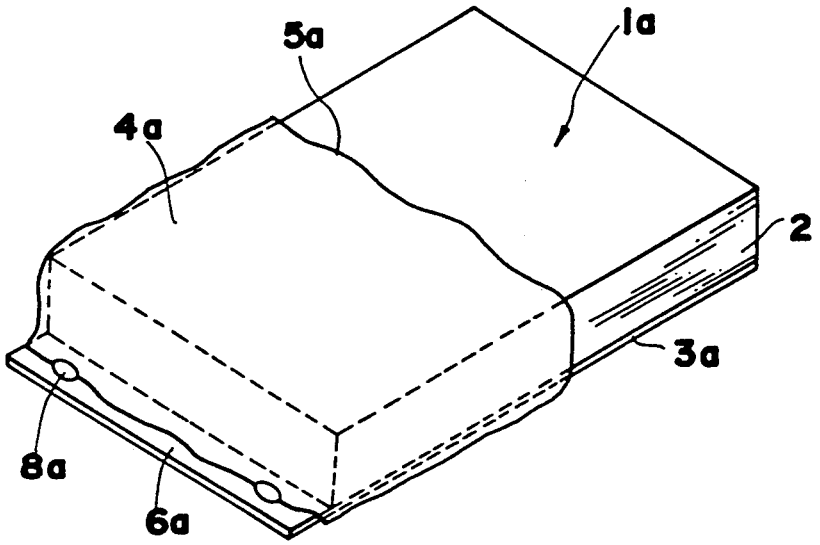
FIG. 5A is a perspective view showing another sheet package as a second embodiment of the invention.

Next, a second embodiment of the invention will be described with reference to FIGS. 5A to 5C. FIG. 5A is a perspective view showing the appearance of a sheet package 1*a* in its entirety. Like the one shown in FIG. 1, the sheet package la is adapted to hermetically enclose a stack of sheets 2 on a base plate 3*a* in a cover 4*a*. The cover 4*a* is similarly formed with a perforated line 5*a* centrally thereof. The package la differs from the package 1 of FIG. 1 in construction in that the projecting portion 6*a* of the base plate 3*a* is formed with engaging holes 8*a*.

The sheet package 1*a* is accommodated in a sheet cassette 10*a*, which comprises a box-shaped body 11*a*. The rubber plate 16 opposed to the restraining portion 18 in the first embodiment is replaced by an engaging member 16*a* which is provided at the rear end (left end in FIG. 5B) of the cassette body 11*a* as seen in FIG. 5B. The engaging member 16*a* is formed with projections 19*a* which are so positioned as to engage in the respective holes 8*a* of the package projecting portion 19*a*. An upper cover 17*a* has a restraining portion 18*a* extending into the cassette body 11*a* and flat-ended to hold the projections 19*a*.

With the present embodiment, the upper cover 17*a* is removed, and the sheet package 1*a* opened by removing the forward portion (toward the feed direction) of the cover 4*a* is placed into the cassette body 11*a*with the projections 19*a* of engaging member 16*a* of the body 11*a* inserted in the holes 8*a* of the package projecting portion 6*a*. When the upper cover 17*a* is then fitted over the cassette body 11*a*, the cover restraining portion 18*a* fixedly holds the package projecting portion 6*a*. The cassette 10*a* of the present embodiment is loaded into the printer body to feed the sheets 2 in exactly the same manner as illustrated in FIGS. 4A and 4B, so that the method thereof will not be described again.

The present embodiment is therefore adapted to reliably fix the sheet package in position in the case where the package can not be restrained by the restraining portion 18 which is sharp-ended as shown in FIGS. 3 to 4 or saw-toothed, i.e., in the case where the base plate 3*a* of the package 1*a* is made, for example, of a hard synthetic resin or the like. A bending groove 7 is formed in the lower side of the package base plate 3*a* in the vicinity of rear end of stack of sheets 2.

Figure 5B:
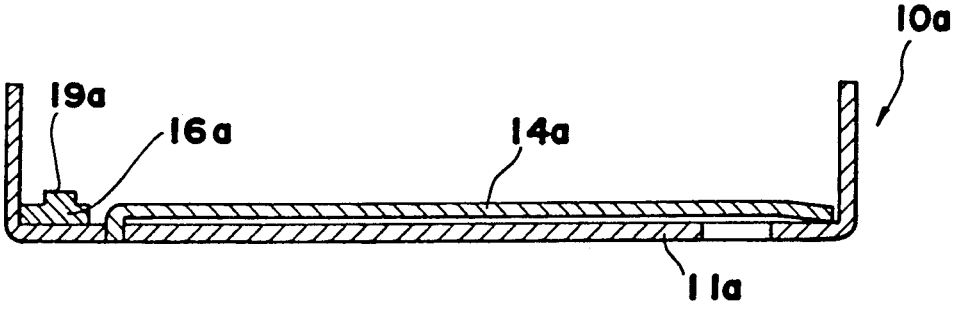
FIG. 5B is a side elevation showing the body of a sheet cassette for use with the sheet package of FIG. 5A.
Figure 5C:
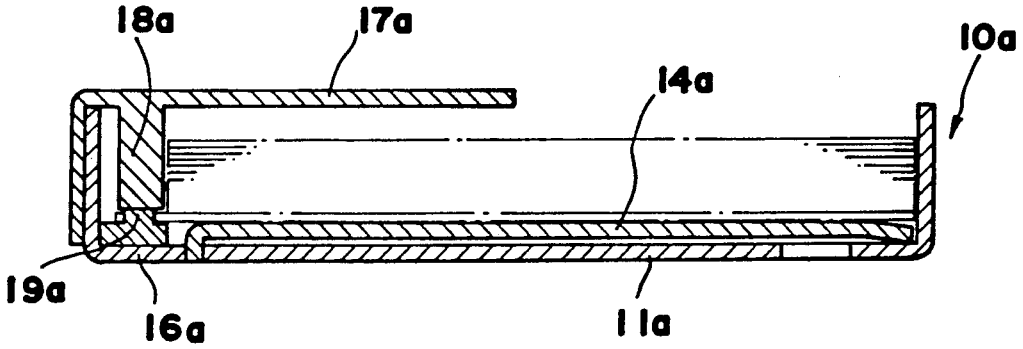
FIG. 5C is a side elevation showing an upper cover as fitted over the cassette body.
Figure 6A:
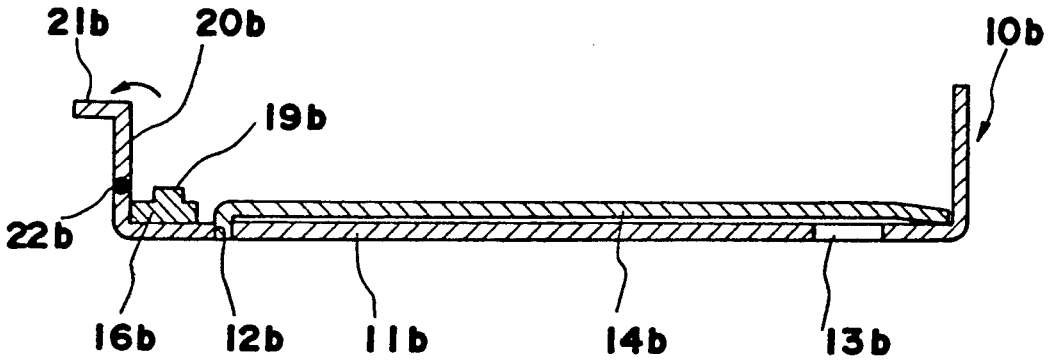
FIGS. 6A and 6B are side elevations showing another sheet cassette as a third embodiment of the invention.
Figure 6B:
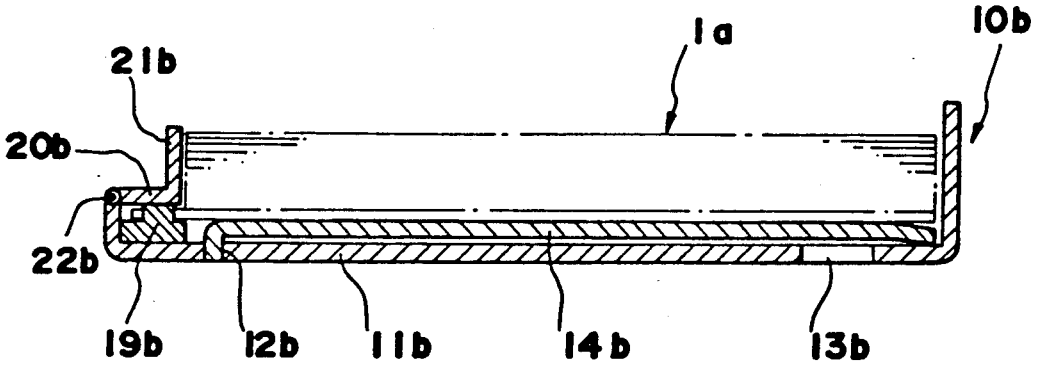

With reference to FIGS. 6A and 6B, a third embodiment of the invention will be described next, in which the sheet cassette need not be provided with the upper cover. More specifically, a sheet cassette 10*b* consists only of a box-shaped cassette body 11*b*. The rear wall of the body has an outwardly extending flange portion 21*b* and a restraining portion 20*b* which are in an inverted L-shaped arrangement. The restraining portion 20*b* is foldable about a pivot 22*b* having an unillustrated coiled torsion spring through a right angle inwardly of the cassette body 11*b* approximately to the same level as projections 19*b* of an engaging member 16*b* similar to the engaging member 16*a* of FIGS. 5B and 5C. When thus folded through a right angle, the restraining portion 20*b* holds the projections 19*b* of the engaging member 16*b* which is provided in the same manner as the member 16*a* of the second embodiment shown in FIGS. 5A and 5C.

Accordingly, the sheet package 1*a* shown in FIG. 5A can be fixed to the cassette 10*b* by placing the package 1*a* into the cassette 10*b* with the projections 19*b* of the engaging member 16*b* engaged in the holes 8*a* of the base plate projecting portion 6*a*, and folding the rear wall restraining portion 20*b* through a right angle. The flange portion 21*b* serves as a guide for the rear ends of the sheets 2. The sheet cassette 10*b*, which has no upper cover, is simple in construction and can be manufactured at a reduced cost.

A fourth embodiment of the invention will be described with reference to FIGS. 7A to 7C. With the embodiments described above, the projecting portion of the sheet package is formed longitudinally of the sheets to fix the package, whereas with the present embodiment, the base plate is projected widthwise of the sheets to fix the package.

Figure 7A:
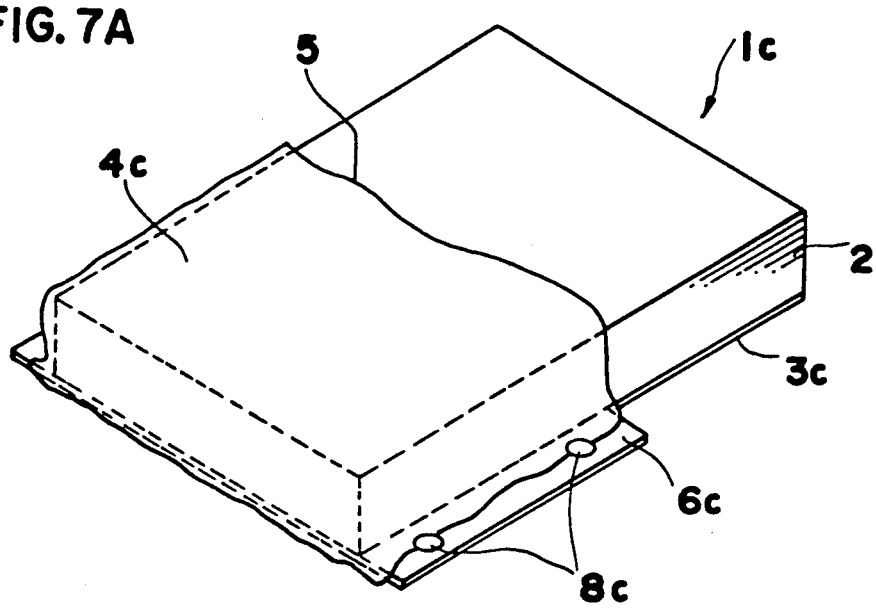
FIG. 7A is a perspective view showing another sheet package as a fourth embodiment of the invention.
Figure 7B:
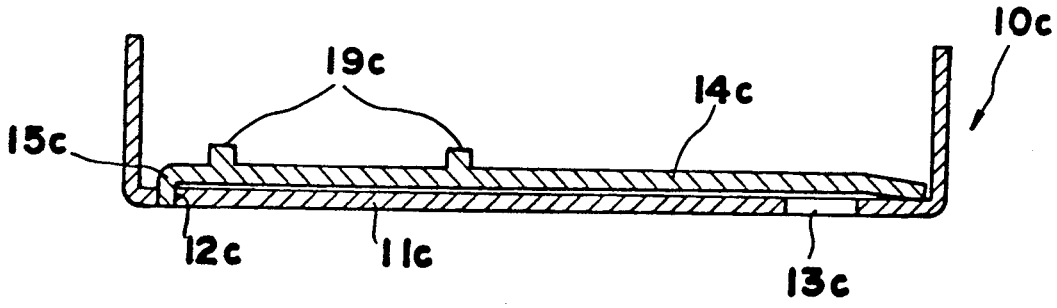
FIGS. 7B and 7C are side elevations showing a sheet cassette for use with the sheet package of FIG. 7A.
Figure 7C:
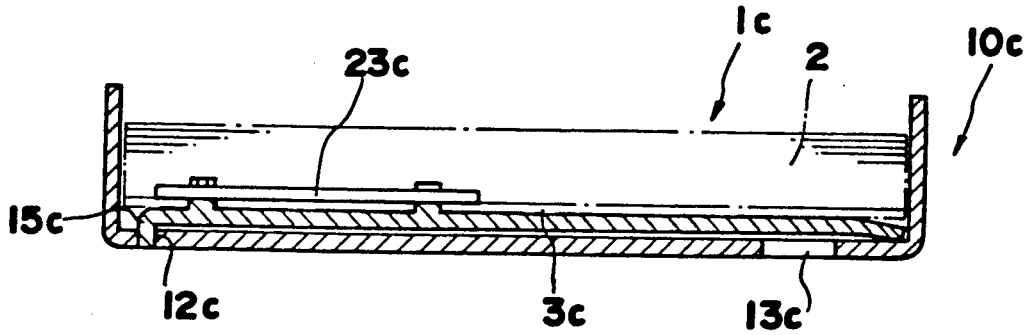

FIG. 7A is a perspective view showing the appearance of a sheet package lc in its entirety. A base plate 3*c* is formed toward its rear end with a projecting portion 6*c* extending widthwise of the sheets 2. The sheets 2 are hermetically enclosed in a cover 4*c* of vinyl or the like. Like the sheet package 1 shown in FIG. 1, the cover 4*c* is centrally formed with a perforated line 5, along which the cover portion toward the feed direction can be torn off to open the package 1*c*.

The sheet package 1*c* is accommodated in a sheet cassette 10*c*, which differs from the cassette body 11*a* shown in FIG. 5B in that the cassette 10*c* is larger than the body 11*a* widthwise of the sheets by an amount corresponding to the projecting portion 6*c* and is smaller than the body 11*a* longitudinally of the sheets by an amount corresponding to the projecting portion 6*a*. A feed plate 14*c* having a bent rear end 15*c* fitted in an aperture 12*c* of the body 11*c* of the cassette is provided on the bottom wall of the body 11*c*. The feed plate 14*c* has projections 19*c* positioned in corresponding relation with engaging holes 8*c* formed in the projecting portion 6*c* of the package 1*c*. Accordingly, the sheet package 1*c* is set in the cassette 10*c* merely by opening the package 1*c* first by removing the portion toward the feed direction of the package cover 4*c*, placing the package 1*c* into the cassette 10*c* with the feed plate projections 19*c* engaged in the respective holes 8*c* in the projecting portion 6*c*, placing a restraining member 23*c* on the projections 19*c* and fastening the member 23*c* to the projections 19*c* as by screwing. The cassette is loaded into the printer body to feed the sheets exactly in the same manner as already described. When the projections 19*c* are each made of a magnet and the restraining member 23*c* of an iron plate, the restraining member can be attached by a snap-in action.

Figure 8A:
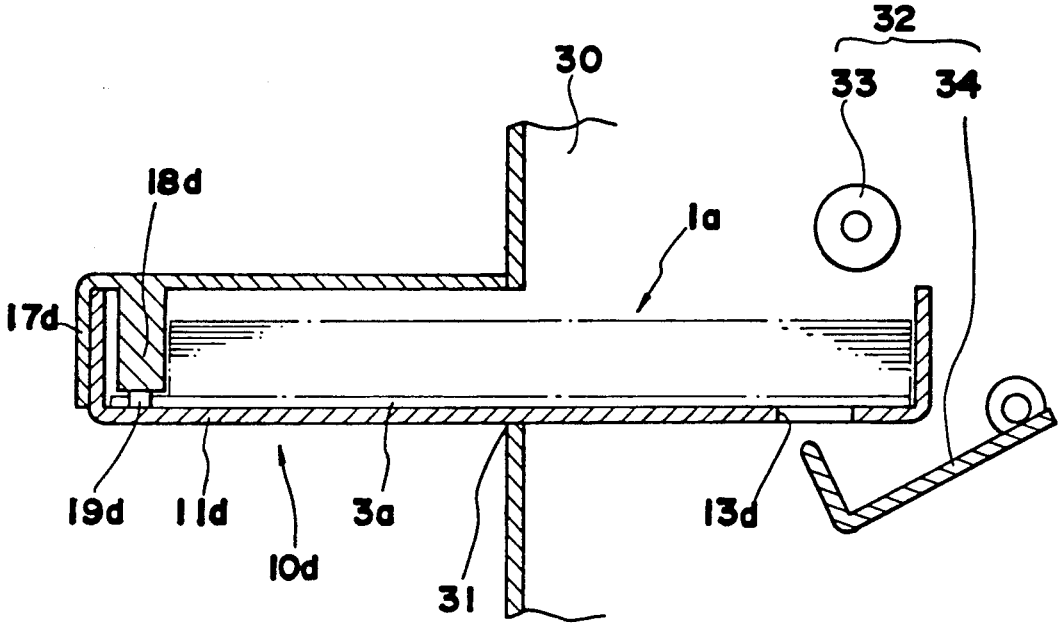
FIGS. 8A and 8B are fragmentary side elevations in section showing another sheet cassette as a fifth embodiment of the invention, as loaded into the printer body.

Next, a fifth embodiment of the invention will be described with reference to FIGS. 8A and 8B, which are fragmentary views in section showing a sheet cassette 10*d* as loaded into the printer body and as set in condition for sheet feeding, respectively. More specifically, the cassette 10*d* is loaded into the printer body through the cassette inlet 31 thereof. The body 11*d* of the cassette is in the form of a box and is provided at its rear end with restraining projections 19*d* engageable in the respective engaging holes 8*a* formed in the projecting portion 6*a* of base plate 3*a* of the sheet package 1*a* shown in FIG. 5A. Like the upper cover 17*a* shown in FIG. 5C, an upper cover 17*d* has a restraining portion 18*d* for holding the projections 19*d* of the cassette body 11*d* from above.

The sheet package 1*a* of FIG. 5A is loaded into the printer body 30 by removing the forward portion (toward the feed direction) of the cover 4*a* along the perforated line 5 to open the package 1*a* first, then placing the package 1a into the cassette 10d with the projections 19d engaged in the holes 8a of the projecting portion 6a, and subsequently placing the cassette 10d into the printer body 30.

Figure 8B:
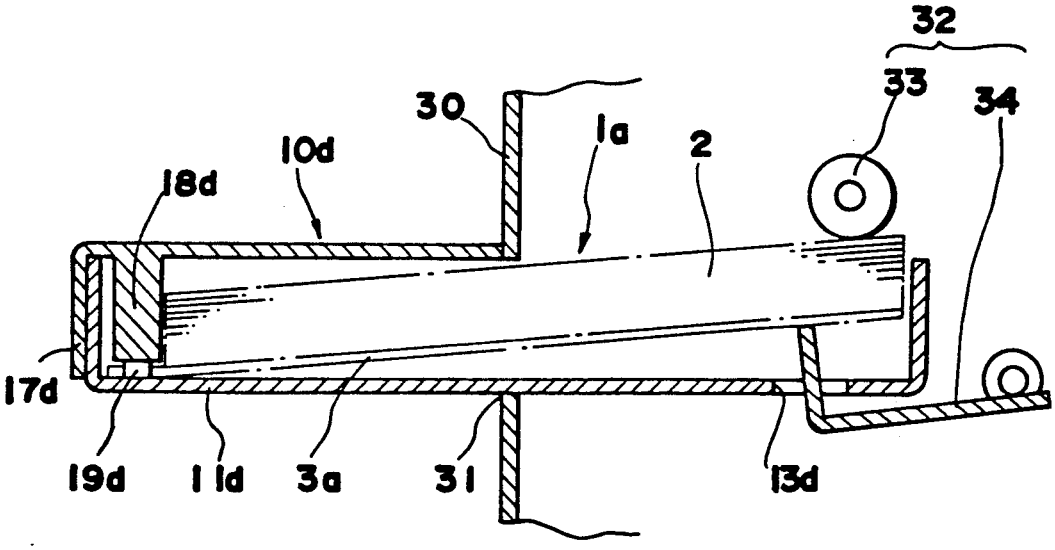

For sheet feeding, the free end of the pushing-up lever 32 is moved through an opening 13d formed in the bottom wall of the cassette body 11d to lift the front end portion of the package base plate 3a from below, thereby bringing the uppermost sheet 2 into contact with the feed roller 33 as seen in FIG. 8B. The roller 33 is then driven to send out the sheets one by one.

With the present embodiment, the feed plate provided in the sheet cassette according to the first to the fourth embodiments can be dispensed with, so that the present embodiment is correspondingly less costly.

Figure 9:
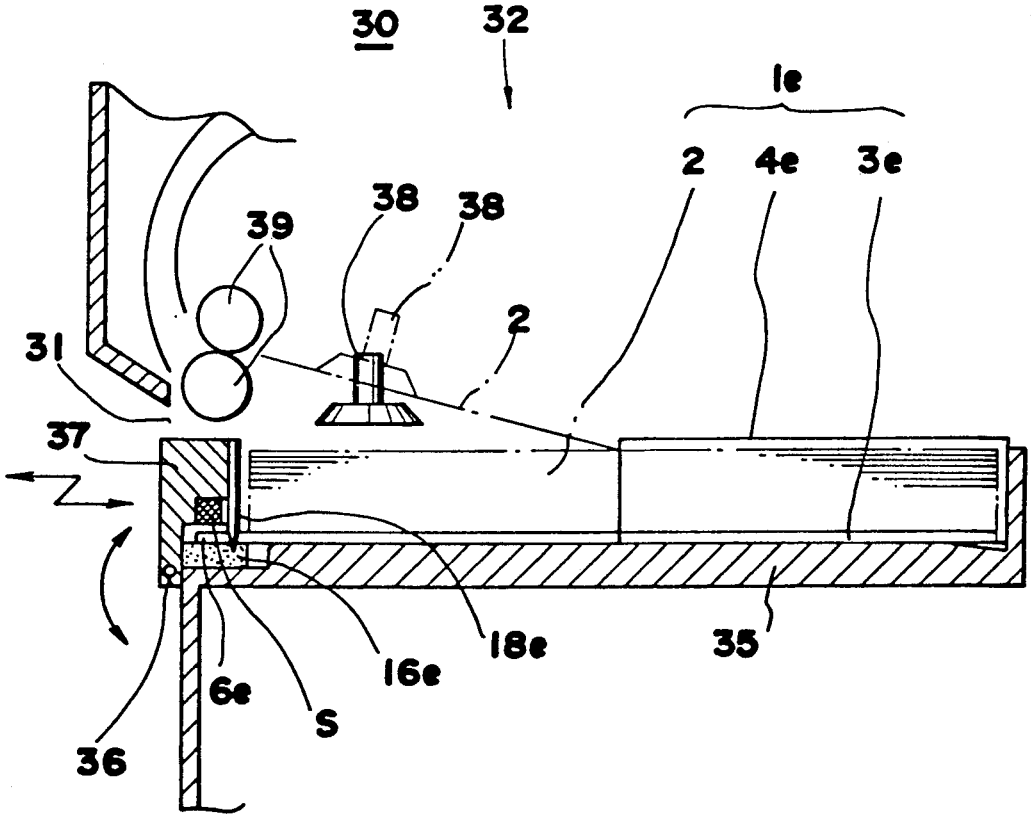
FIG. 9 is a side elevation in section showing a sheet feeder as a sixth embodiment of the invention.
Figure 10A:
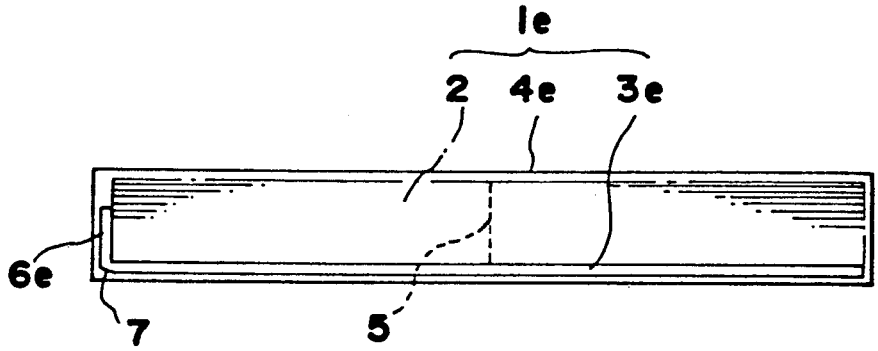
FIG. 10A is a side elevation showing the sheet package of FIG. 9 with sheets enclosed in a cover.
Figure 10B:
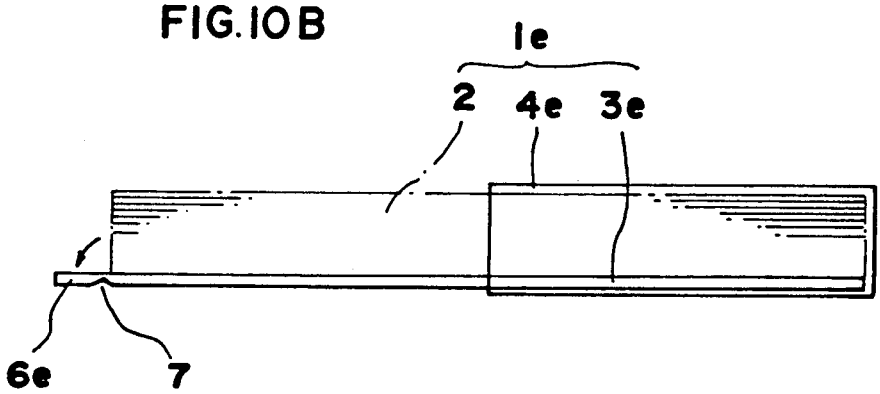
FIG. 10B is a side elevation showing the cover opened with one half thereof broken away.
Figure 10C:
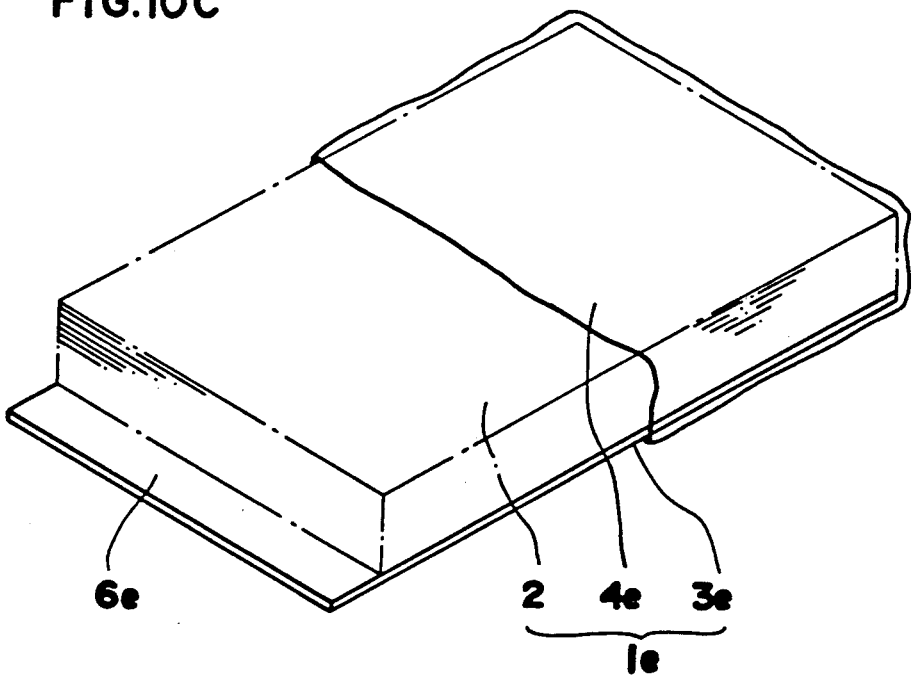
FIG. 10C is a perspective view showing the same.

FIG. 9 is a side elevation in section showing a sixth embodiment of the invention including a sheet package 1e. FIG. 10A is a side elevation showing the package 1e with sheets hermetically enclosed in a cover 4e, FIG. 10B is a side elevation showing the cover 4e as opened with half thereof broken away, and FIG. 10C is a perspective view showing the same.

The sheet package le includes a base plate 3e which has a projecting portion 6e at one end thereof so as to project laterally beyond the stack of sheets 2. According to the illustrated embodiment, the projecting portion 6e, when enclosed in the cover 4e, is bent vertically along and pressed against the end face of the stack of sheets 2 by the cover (see FIG. 10A). When half of the cover 4e is removed to open the package 1e, the projecting portion 6e is unfolded to a vertical position to extend laterally beyond the stack of sheets 2 (see FIGS. 10B and 10C). The illustrated case is not limitative; alternatively, the portion 6e projecting laterally as originally formed in alignment with the base plate 3e may be enclosed in this state in the cover 4e along with the sheets 2.

As shown in FIG. 9, the feeder for the sheet package 1e comprises a guide plate 35 for placing the package 1e directly thereon, a restraining portion 18e engageable with the projecting portion 6e of the base plate 3e for fixing the sheet package 1e to the guide plate 35, a sensor S serving as means for detecting the projecting portion 6e engaged by the restraining portion 18e, and feed means 32.

These components will be described in detail. The body 30 of the printer has an inlet 31, and the guide plate 35 is disposed horizontally inwardly of the inlet 31. The guide plate 35 is provided at one end thereof close to the inlet 31 with a rubber plate 16e flush with the plate 35. The sheet package 1e with the cover 4e partly removed toward one end thereof is inserted, at the other end thereof, into the inlet 31 from the left rightward in the drawing and loaded in position with the base plate 3e placed on the guide plate 35. In this loaded state, the projecting portion 6e positioned toward the feed direction, i.e., immediately behind the inlet 31, rests on the rubber plate 16e.

At the lower side of the inlet 31 of the printer body 30, a flange portion 37 is movably mounted on a horizontal pivot 36. The flange portion 37 is pivotally movable between a retracted position and an operative position. More specifically, the flange portion 37 is movable counterclockwise in the drawing to the retracted position away from the inlet 31, permitting the sheet package 1e to be brought into and out of the loaded position. Conversely, the portion 37 in this position moves clockwise in the drawing to the operative position, where the flange portion 37 almost closes the inlet 31 and is located above the rubber plate 16e with the package projecting portion 6e interposed therebetween. The flange portion 37 is provided with the restraining portion 18e which, like the restraining portion 18 of the first embodiment, penetrates through the projecting portion 6e into the rubber plate 16e when the flange portion 37 is in the operative position. For example in this way, the restraining lo portion 18e is engageable with the base plate projecting portion 6e of the sheet package 1e loaded in place, thereby serving to fix the package 1e to the guide plate 1e.

The detecting means, i.e., the sensor S is mounted on the flange portion 37 beside the restraining portion 18e. In its operative position, the sensor S is opposed to the package projecting portion 6e to detect this portion. The sensor S comprises, for example, a light emitter and a photodetector. In the case where the package 1e is loaded, the light projected from the emitter is reflected from the projecting portion 6ewhich is for example white, and the reflected light is detected by the photodetector. Otherwise, i.e., if the package 1e is not loaded, the light projected from the emitter impinges on but will not be reflected at the rubber plate 16e which is for example black, with the result that the photodetector receives no reflected light.

With the illustrated embodiment, the feed means 32 is of the suction type and comprises a vacuum cup 38. The vacuum cup 38 is positioned above a portion of the loaded sheet package 1e closer to the inlet 31, i.e., above the opened portion of the package 1e from which the cover 4e has been removed and which is positioned toward the feed direction, the cup 38 further being movable upward and downward. Of the sheets 2 contained in the package 1e, the uppermost sheet 2 is attracted and lifted by the vacuum cup 38 and then transported by a pair of transport rollers 39 to the subsequent processing unit, i.e., printer unit, within the body 30. When lifted by suction with the vacuum cup 38, the sheet 2 becomes slightly bent at the broken opened edge of the cover 4e as indicated in a phantom line in the drawing. Accordingly, a plurality of sheets 2 are likely to be lifted by suction, whereas the uppermost sheet 2 will then be separated from the underlying sheet owing to the stiffness of sheets which forms a clearance therebetween. Thus, the uppermost sheet 2 only can be fed reliably.

The sheet feeder of the sixth embodiment having the foregoing construction is used and operates in the following manner.

When to be loaded, the package 1e having the sheets 2 enclosed therein is opened by removing half of the cover 4e along the perforated line 5 as shown in FIGS. 10B and 10C. With the flange portion 37 then moved to its retracted position, the sheet package 1e is inserted, at the covered end thereof, into the inlet 31 from the left rightward in FIG. 9 and loaded into the feeder by placing the base plate 3e on the guide plate 35.

As shown in FIG. 9, the flange portion 37 is thereafter pivotally moved to its operative position, causing the restraining portion 18e to engage the base plate projecting portion 6e of the package 1e with the rubber plate 16e to thereby fix the package 1e to the guide plate 35. The package 1e as loaded in place within the feeder is detected by the sensor S which detects the projecting portion 6e in this state. Subsequently, only the uppermost sheet 2 in the package 1e is lifted by suction with the vacuum cup 38 and fed to the next unit by the pair of transport rollers 39.

Figure 11:
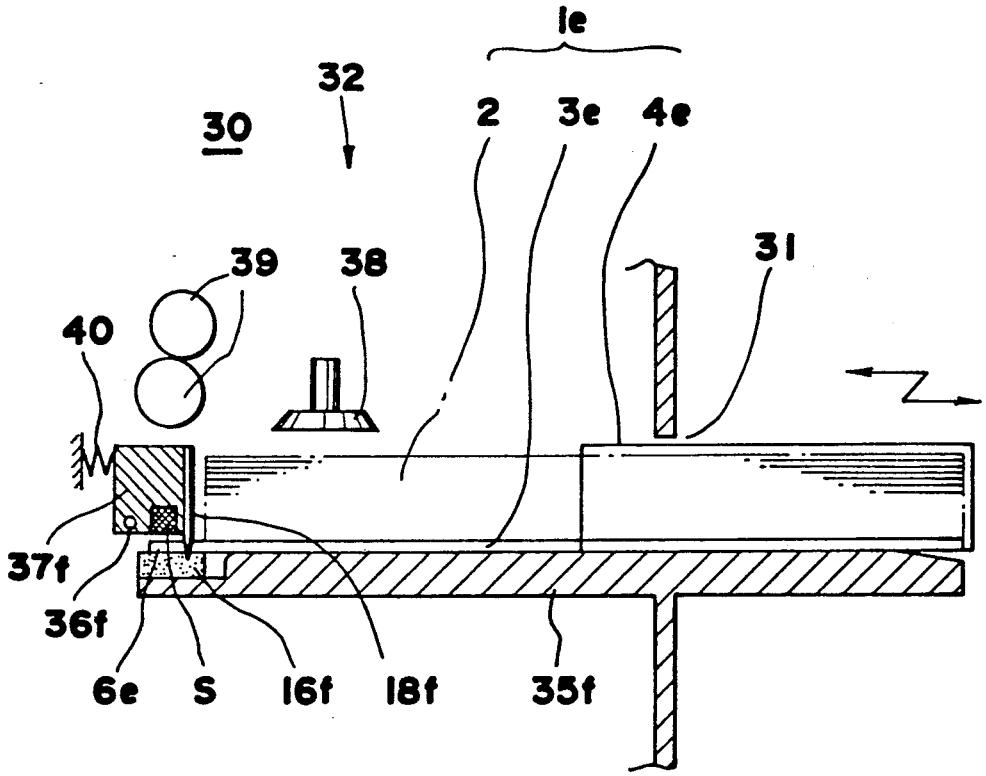
FIG. 11 is a side elevation in section showing another sheet feeder as a seventh embodiment of the invention.

FIG. 11 is a side elevation in section showing a seventh embodiment of the invention.

With the seventh embodiment, i.e., another sheet feeder, a guide plate 35*f* extends across an inlet 31 and is provided with a rubber plate 16*f* at its inner end opposite to the inlet 31. Similarly inside the body 30 of the feeder away from the inlet 31, a flange portion 37*f* is mounted on a horizontal pivot 36*f* on the body. The flange portion 37*f* is always biased clockwise in the drawing by the force of a spring 40 connected between a frame on the body and the flange portion 37*f* and is held in an operative position above the package projecting portion 6*e* on the rubber plate 16*f* when the sheet package 1*e* is loaded in position. When the package 1*e* is to be loaded or removed, the flange portion 37*f* is slightly moved counterclockwise in the drawing by an unillustrated release mechanism against the force of the spring 40. As is the case with the sixth embodiment, the flange portion 37*f* is provided with a restraining portion 18*f* and a sensor S serving as detecting means, and a vacuum cup 39 serving as feed means is provided in a specified position.

With the sheet feeder of the seventh embodiment shown in FIG. 11 unlike the sixth embodiment of FIG. 9, the sheet package 1*e* is inserted into the feeder at one end thereof which is positioned toward the feed direction and which is opened by partly removing the cover 4*e*, from the right leftward in FIG. 11. The sheet package 1*e* is base plate 3*e* on the guide plate 35*f* and causing the restraining portion 18*f* to engage the base plate projecting portion 6*e* with the rubber plate 16*f* by the force of the spring 40.

The construction, function and operation of the other members of the seven embodiment are similar to those of the sixth embodiment and therefore will not be described.

Figure 12:
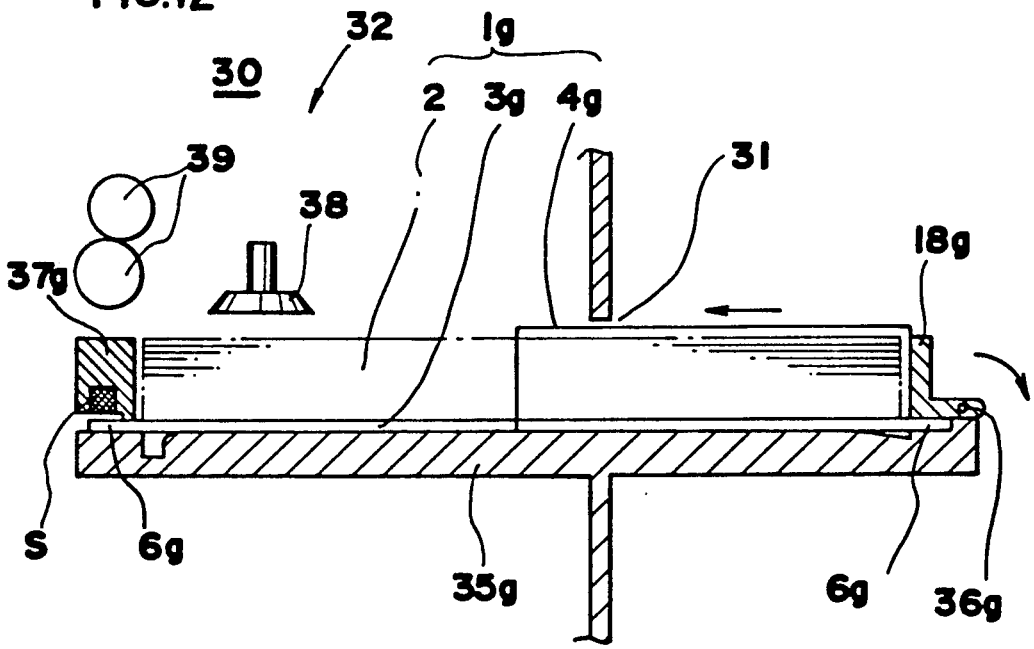
FIG. 12 is a side elevation in section showing another sheet feeder as an eighth embodiment of the invention.
Figure 13:
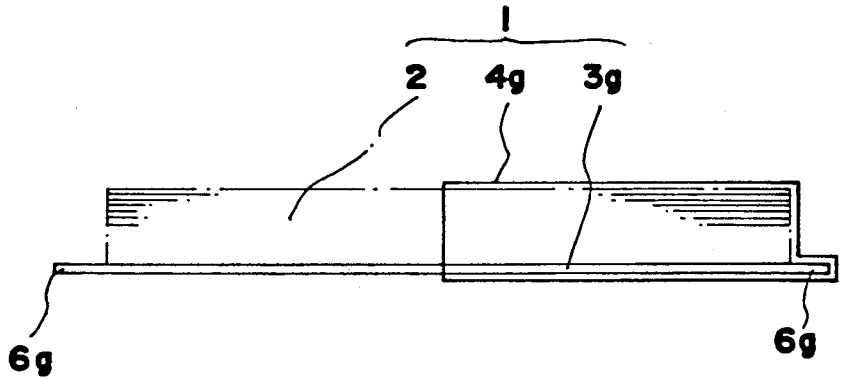
FIG. 13 is a side elevation showing the sheet package of FIG. 12 as opened with one half of its cover broken away.

While the seventh embodiment is constructed as above, FIG. 12 is a side elevation in section showing an eighth embodiment of the invention. FIG. 13 is a side elevation showing a sheet package 1*g* included in the embodiment and opened by tearing off half of a cover 4*g*.

In the sheet feeder of the eighth embodiment, a projecting portion 6*g* is provided at each end of a base plate 3*g*, i.e., not only at the opened end thereof from which the cover 4*g* is removed and which is toward sheet feed direction but also at the opposite covered end thereof as shown in FIG. 13.

With reference to FIG. 12, a guide plate 35*g* extends across an inlet 31 as in the seventh embodiment and is provided with a restraining portion 18*g* at its outer end. The restraining portion 18*g* is generally L-shaped and supported at its base end by a horizontal pivot 36*g* on the end of the guide plate 35*g*. The restraining portion 18*g* is movable clockwise in the drawing to a retracted position permitting the sheet package 1*g* to be inserted into and out of the inlet 31. Conversely, the portion 18*g* is movable counterclockwise in the drawing to an operative position as illustrated where the portion 18*g* is located on the outer end of the guide plate 35*g* in engagement with one of the projecting portions 6*g* of the sheet package 1*g* loaded. Disposed above the inner end of the guide plate 35*g* is a sensor S serving as detecting means and attached to a flange portion 37*g*. The sensor S is opposed to the other projecting portion 6*g* of the sheet package 1*g* loaded to detect the portion 6*g*.

With the sheet feeder of the eighth embodiment as in the seventh embodiment, the sheet package 1*g* is loaded, at the opened end thereof toward the feed direction, into the feeder through the inlet 31 from the right leftward in FIG. 12. The package 1*g* is fixed to the guide plate 35*g* by the engagement of the restraining portion 18*g* with one of the projecting portions 6*g*. The package 1*g* thus loaded in place is recognized by the sensor S which detects the other projecting portion 6*g*.

With the eighth embodiment, the sheet package 1*g* loaded can be fixed in place more reliably by providing engaging projections on the outer end of the guide plate 35*g* for engagement with corresponding holes formed in one of the projecting portions 6*g*, and making the restraining portion 18*g* engageable with the projections as engaged in the respective holes of the portion 6*g* in the loaded state.

The other projecting portion 6*g* of the sheet package 1*g* as loaded, which is detectable by the sensor S, may further be made engageable by some engaging means provided on the feeder. The base plate 36*g*, i.e., the package 16*g*, can then be fixed in place more reliably. In other words, the engageable projecting portion 6*g* is not limited to one in number; if at least two engageable projecting portions are provided, the sheet package 1*g* can be fixed in place more effectively.

Moreover, the projecting portions 6*g* provided at the respective ends of the base plate 3*g* may be made different in the amount of projection, i.e., the length. This precludes the likelihood that the sheet package 1*g* to be loaded will be reversely inserted into the inlet 31 in error. For example, if the projecting portion 6*g* to be detected by the sensor S is made longer than the other, the longer portion 6*g* can be readily recognized as indicating the leading end of the package 1*g* to be inserted and is also detectable by the sensor S more easily.

Figure 14:
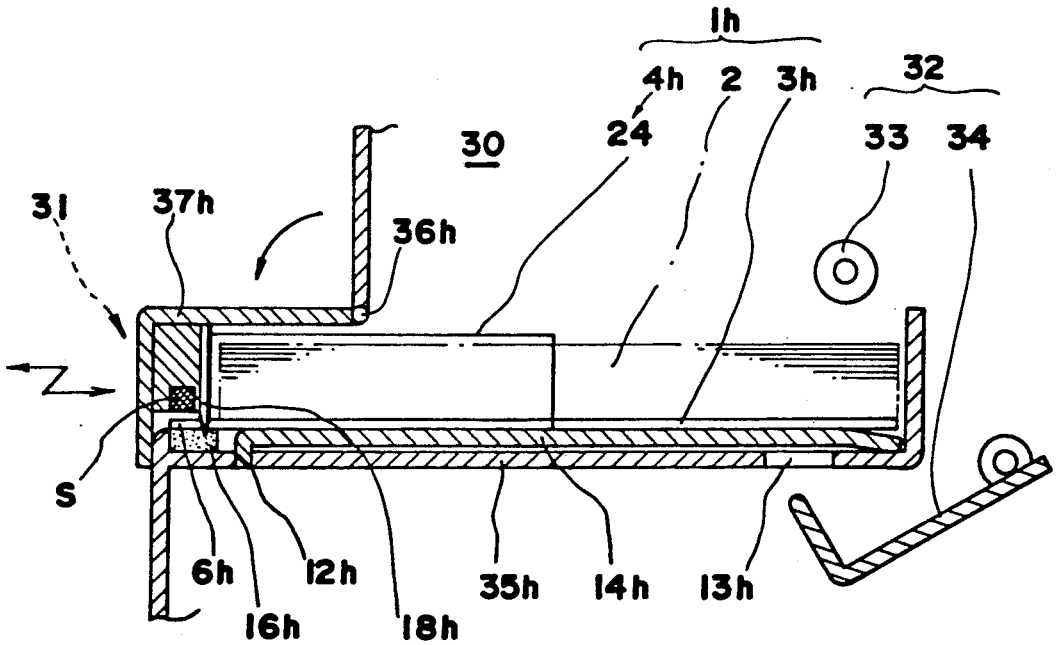
FIG. 14 is a side elevation in section showing another sheet feeder as a ninth embodiment of the invention.
Figure 15A:
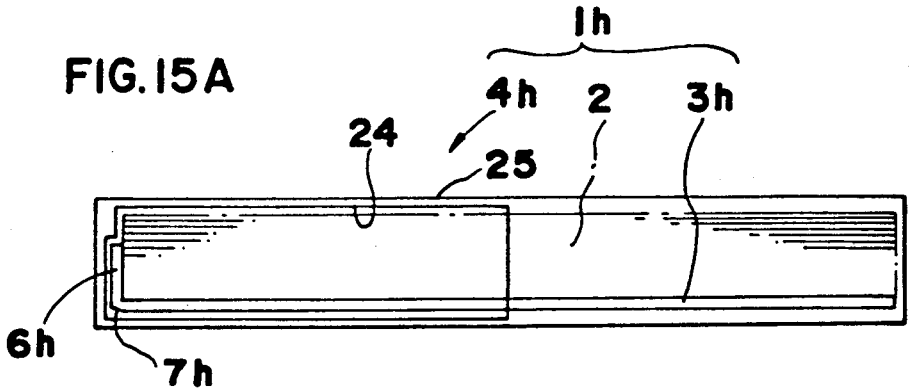
FIG. 15A is a side elevation showing the sheet package of FIG. 14 with sheets enclosed in a cover.
Figure 15B:
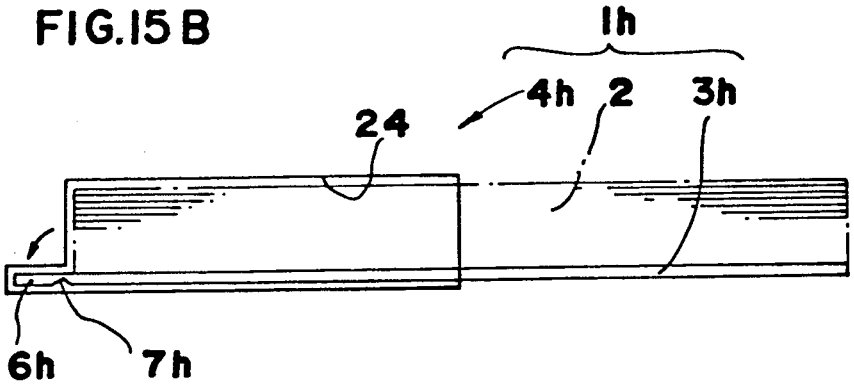
FIG. 15B is a side elevation showing the same as opened with one half of its cover broken away.
Figure 15C:
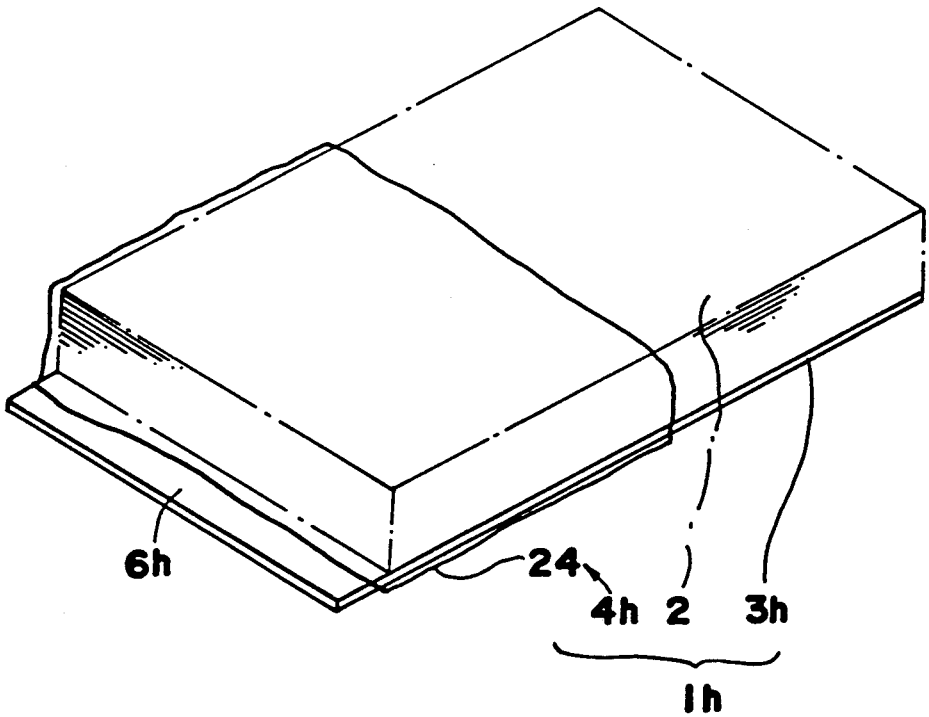
FIG. 15C is a perspective view showing the same.

FIG. 14 is a side elevation in section showing a ninth embodiment of the invention. FIG. 15A is a side elevation showing a sheet package 1*h* included in the embodiment and having sheets enclosed in a cover 4*h*. FIG. 15B is a side elevation showing the package as opened by partly breaking the cover 4*h* away, and FIG. 15C is a perspective view showing the package in the same state.

With the sheet feeder of the ninth embodiment, the sheet package 1*h* to be used has a base plate 3*h* formed with a projecting portion 6*h* which is positioned in the same relation with the base plate as in the first to the fifth embodiments already described. As seen in FIG. 15B, the projecting portion 6*h* is provided only at one end of the base plate 3*h* where the cover 4*h* remains unremoved and which is opposite to the feed direction. As shown in FIG. 15A, the cover 4*h* of the sheet package 1*h* is of double structure and comprises an inner first cover 24 and an outer second cover 25. The inner first cover 24 covers only one half of the stack of sheets 2 and is absent around the other half of the stack as by being removed and therefore left open. The outer second cover 25 is provided over the first cover 24 and covers the stack of sheet 2 in its entirety. Accordingly, the cover 4*h* need not be formed with the perforated line 5 (see FIG. 10A). The second cover 25, when merely removed entirely, permits the remaining first cover 24 to partly enclose the stack and leave only half of the package 1*h* open as shown in FIGS. 15B and 15C.

Further with reference to FIG. 14, a guide plate 35*h* is disposed inwardly of an inlet 31 as is the case with the sixth embodiment. Provided on the guide plate 35*h* is a feed plate 14h which is slightly pivotally movable about its outer end 15h. The sheet package 1h is set in place with the base plate 3h positioned over the feed plate 14h. A rubber plate 16h flush with the feed plate 14h is disposed at the outer end of the guide plate 35h close to the inlet 31. At the upper side of the inlet 31, a flange portion 37h is supported on a horizontal pivot 36h. The flange portion 37h is movable to a retracted position or to an operative position, in which the portion 37h serves as an upper cover as illustrated, and is provided with a restraining portion 18h and a sensor S.

Like the first embodiment, the present embodiment has feed means 32 which comprises a pushing-up lever 34 and a feed roller 33.

The construction, function and operation of the other members of the present embodiment are similar to those of the first and like embodiments and therefore will not be described.

With any of the sixth to ninth embodiments described, the sheet package is loaded directly in the sheet feeder, whereas the present invention is not limited to this mode of loading. For example, the sheet package may be accommodated in a sheet cassette, which may be placed on holding means of the sheet feeder so as to load the package into the sheet feeder by means of the cassette.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. A sheet package for use in a sheet feeder of an image forming apparatus, comprising:

a cover for covering a stack of sheets in its entirety and openable by breaking away a front-side portion of the cover to leave a rear-side portion of the cover in the package and to uncover and expose at least an end portion of the stack of sheets including at least a portion of a surface of a top sheet of the stack of sheets; and a member arranged at the rear-side portion of the cover and extending outward from the bottom of the stack of sheets to prevent the cover from being fed by the sheet feeder;

wherein the sheets covered with the rear-side portion of the cover are fed by the sheet feeder one by one.

2. A sheet package according to claim 1, which further comprises:

a base plate for supporting the stack of sheets and the same is formed to extend out from the stack of sheets to constitute said member.

3. A sheet package according to claim 2, wherein said member is so formed with at least one engaging hole for fixing the member in a fixed place of said sheet feeder.

4. A sheet feeding apparatus, comprising:

supporting means for supporting a sheet package having a cover for covering a stack of sheets in its entirety and openable by breaking away a front-side portion of the cover leaving a rear-side portion thereof in the package to expose at least an end portion of the stack of sheets and a member extending outward from the rear-side portion;

feeding means for feeding the sheets accommodated in the sheet package supported by the supporting means one by one; and holding means for fixedly holding the extending member of the sheet package supported by the supporting means to prevent the cover from being fed by said feeding means.

5. A sheet feeding apparatus according to claim 4, wherein said extending member of the sheet package is so formed with at least one engaging hole for fixing the rear-side portion of the cover in a fixed place of the supporting means and said holding means includes at least one projection provided at the fixed place for engagement with the engaging hole.

6. A sheet feeding apparatus according to claim 5, which further comprises:

cover means for covering the sheet package supported by the supporting means and having a restraining portion against the projection of the holding means.

7. A sheet cassette for use in a sheet feeder of an image forming apparatus, comprising:

a body for accommodating a sheet package having a cover for covering a stack of sheets in its entirety and openable by breaking away a front-side portion of the cover to leave a rear-side portion thereof and to uncover and expose at least an end portion of the stack of sheets including at least a portion of a surface of a top sheet of the stack of sheets, and a member extending outward from the rear-side portion of the cover, said body being detachable from and attachable to the sheet feeder of the image forming apparatus; and holding means for fixedly holding the extending member of the sheet package in a fixed place of said body to prevent the cover of the sheet package from being fed by the sheet feeder;

wherein the sheets covered with the rear-side portion of the cover are fed by the sheet feeder one by one.

8. A sheet cassette according to claim 7, wherein said extending member of the sheet package is so formed with at least one engaging hole for fixing the rear-side portion of the cover and said holding means includes at least one projection provided at the fixed place of the body for engagement with the engaging hole of the extending member.

9. A sheet cassette according to claim 8, which further comprises:

cover means for covering the body and having a restraining portion against the projection of the holding means.

10. A sheet cassette according to claim 8, wherein said body includes a restraining portion against the projection of the supporting means, said restraining portion being movable between a restraining position and a release position.

11. A sheet feeding apparatus, comprising:

supporting means for supporting a sheet package having a cover for covering a stack of sheets in its entirety and openable by breaking away a front-side portion of the cover leaving a rear-side portion thereof to expose at least an end portion of the stack of sheets and a base plate for supporting the stack of sheets thereon, said base plate having an extending portion extending outward from one end of the stack of sheets;

feeding means for feeding the sheets accommodated in the sheet package supported by the supporting means one by one; and detecting means for detecting the extending portion of the sheet package supported by the supporting means.

12. A sheet feeding apparatus according to claim 11, which further comprises:

holding means for fixedly holding the extending portion of the sheet package in a fixed place of the supporting means.

13. A sheet package for use in a sheet feeder of an image forming apparatus. comprising:

a cover for covering a stack of sheets in its entirety and having perforations between a front-side portion and a rear-side portion of the cover; and a member arranged at the rear-side portion of the cover and extending outward from the bottom of the stack of sheets to prevent the cover from being fed by the sheet feeder;

wherein the sheets covered with the rear-side portion of the cover are fed by the sheet feeder one by one.

14. A sheet package according to claim 13, which further comprises:

a base plate for supporting the stack of sheets, the base plate being formed to extend out from the stack of sheets to constitute said member.

15. A sheet package according to claim 14, wherein said member is so formed with at least one engaging hole for fixing the member in a fixed place of said sheet feeder.

* * * * *

UNITED STATES PATENT AND TRADEMARK OFFICE

CERTIFICATE OF CORRECTION

PATENT NO. : 5,137,269

DATED : August 11, 1992

INVENTOR(S) : Junichi Yamamoto

It is certified that error appears in the above-identified patent and that said Letters Patent is hereby corrected as shown below:

In Col. 2, line 34, change "FIG. B" to --FIG. 3B--.

In Col. 8, line 9, delete "1o".

In Col. 9, line 31, before "base plate 3e", insert --fixedly loaded onto the guide plate 35f by placing the--.

In Col. 10, line 21, change "36g" to --3g--.

In Col. 10, line 22, change "16g" to --1g--.

In Col. 13, line 13 (claim 13, line 2), change "." (period) to --,-- (comma).

Signed and Sealed this

Thirty-first Day of August, 1993

Bruce Lehman

*Attest:*

BRUCE LEHMAN

*Attesting Officer*

*Commissioner of Patents and Trademarks*